US006533877B1

(12) United States Patent
Davisson et al.

(10) Patent No.: US 6,533,877 B1
(45) **Date of Patent: *Mar. 18, 2003**

(54) PROCESS OF MANUFACTURING HIGH STRENGTH ALUMINUM FOIL

(75) Inventors: Thomas L. Davisson, Chardon, OH (US); Luc M. Montgrain, Terre Haute, IN (US); Sadashiv Nadkarni, Lexington, MA (US)

(73) Assignee: Alcan International Limited, Quebec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/622,488

(22) PCT Filed: Feb. 17, 1999

(86) PCT No.: PCT/CA99/00138

§ 371 (c)(1),
(2), (4) Date: Dec. 6, 2000

(87) PCT Pub. No.: WO99/42628

PCT Pub. Date: Aug. 26, 1999

Related U.S. Application Data

(60) Provisional application No. 60/075,102, filed on Feb. 18, 1998.

(51) Int. Cl.[7] ..... C22F 1/04
(52) U.S. Cl. ..... 148/552; 148/696
(58) Field of Search ..... 148/551, 696, 148/692, 549, 552

(56) References Cited

U.S. PATENT DOCUMENTS

| | | | | |
|---|---|---|---|---|
| 3,716,419 A | * | 2/1973 | Boutin | 148/11.5 |
| 4,334,935 A | * | 6/1982 | Morris | 148/2 |
| 5,380,379 A | | 1/1995 | Maiwald et al. | |
| 5,466,312 A | | 11/1995 | Ward et al. | |
| 6,350,532 B1 | * | 2/2002 | Davisson et al. | 428/606 |

FOREIGN PATENT DOCUMENTS

| | | | |
|---|---|---|---|
| JP | 60-033346 A | * | 2/1985 |
| JP | 06-145923 A | * | 5/1994 |
| WO | WO 95 25825 | | 9/1995 |
| WO | WO 97 36017 | | 10/1997 |
| WO | WO 98 45492 A | | 10/1998 |

OTHER PUBLICATIONS

Patent Abstracts of Japan, vol. 010, No. 310 (C–379), Oct. 22, 1986 & JP 61 119658 A (Sukai Alum KK), Jun. 6, 1986.

Patent Abstracts of Japan, vol. 011, No. 381 (C–464), Dec. 12, 1987 & JP 62 149838 A (Showa Alum Corp.), Jul. 3, 1987.

* cited by examiner

*Primary Examiner*—George Wyszomierski
*Assistant Examiner*—Janelle Combs Morillo
(74) *Attorney, Agent, or Firm*—Cooper & Dunham LLP

(57) ABSTRACT

High strength foil having dead fold foil characteristics is produced without the rolling and other production problems encountered with prior high strength foils by controlling manganese content, interannealing temperatures and, optionally, final annealing temperatures. The alloy contains 0.05 to 0.15 %, preferably 0.095 to 0.125%, manganese by weight. Cold worked sheet is interannealed at a temperature of about 200° C. to about 260° C., preferably 230° to 250 ° C., to produce substantially fully recrystallized sheet while maintaining most of the manganese in solid solution. The interannealed sheet is rolled to final gauge and finally annealed, preferably at a temperature of about 250° C. to about 325° C., more preferably about 260° C. to about 325° C., to produce dead fold aluminum foil with a yield strength of at least 89.6 MPa (13 ksi), and ultimate tensile strength of at least 103.4 MPa (15 ksi) and a Mullen rating of at least 89.6 kPa (13 psi) at a gauge of 0.0015 cm (0.0006 inch).

16 Claims, 1 Drawing Sheet

PROCESS OF MANUFACTURING HIGH STRENGTH ALUMINUM FOIL

CROSS-REFERENCE TO RELATED APPLICATIONS

This application claims the benefit of U.S. provisional application No. 60/075,102, filed Feb. 18, 1998.

TECHNICAL FIELD

This invention relates to the production of aluminum alloy products and, more specifically, to an economical, effective and high productivity process for making high strength aluminum foil.

BACKGROUND ART

Aluminum foil is produced from a number of conventional alloys. Table I below lists nominal compositions and typical properties for annealed foils produced from typical Aluminum Association (AA) alloys.

TABLE 1

| Nominal Compositions and Typical Properties Annealed Foils | | | | | | | |
|---|---|---|---|---|---|---|---|
| Alloy | Si | Fe | Cu | Mn | UTS[1] MPa (ksi) | YS[2] MPa (ksi) | Mullen[3] Kpa (psi) |
| 1100 | 0.06 | 0.45 | 0.12 | — | 73.8 (10.7) | 40.7 (5.9) | 97.2 (14.1) |
| 1200 | 0.17 | 0.65 | — | — | 69.6 (10.1) | 42.1 (6.1) | 59.3 (8.6) |
| 8111 | 0.57 | 0.57 | — | — | 73.8 (10.7) | 46.9 (6.8) | 87.6 (12.7) |
| 8015 | 0.12 | 0.95 | — | 0.2 | 124.1 (18) | 103.4 (15) | 103.4 (15) |
| 8006 | 0.22 | 1.58 | — | 0.43 | 127.6 (18.5) | 92.4 (13.4) | |

[1]UTS = Ultimate Tensile Strength
[2]YS = Yield Strength
[3]The Mullen rating is a standard measure of strength and formability for aluminum foil. A diaphragm is hydraulically pressed against the surface of the foil. The rating is the pressure in kPa (psi) on the foil of a defined thickness at which it bursts.

One method of producing the foil is first to cast an ingot by a process commonly referred to as direct chill or DC casting. Foil made of 8006 alloy is typically produced by the DC casting process. The DC cast ingot is preheated to a temperature around 500° C. and then hot rolled to produce a sheet having a thickness of about 0.2 to 0.38 cm (0.08 to 0.15 inches). This sheet is then cold rolled to a final thickness of 0.00076 to 0.0025 cm (0.0003 to 0.001 inches) to produce a household foil. During the process of cold rolling, the sheet work-hardens, making it impossible to roll it down further once a gauge of 0.005 to 0.010 cm (0.002 to 0.004 inches) is reached. That is why, after a few cold rolling passes (generally at a thickness of 0.005 to 0.05 cm (0.002 to 0.02 inches)), the sheet is interannealed, typically at a temperature of about 275 to about 425° C., to recrystallize and soften the material and ensure easy rollability to the desired final gauge. The thickness of the sheet is normally reduced by about 80 to 99% after the interanneal. Without this anneal, work-hardening will make rolling to the final gauge extremely difficult, if not impossible.

The final gauge may be about 0.0008 to 0.0025 cm (0.0003 to about 0.001 inches). A typical final gauge for household foil is 0.0015 cm (0.00061 inches). When cold rolling is finished, the foil is then given a final anneal, typically at about 325 to 450° C., to produce a soft, "dead fold" foil with the desired formability, and wettability. ("Dead fold" is an industry recognized term for foil that can be folded 180° back upon itself with no spring back.) The final anneal serves the purpose of imparting the dead fold characteristics as well as ensuring adequate wettability by removing the rolling oils and other lubricants from the surface.

Foil is also produced with other alloys such as 1100, 1200, 8111 and 8015 that is first cast as a sheet on continuous casting machines such as belt casters, block casters and roll casters. Continuous casting is usually more productive than DC casting because it eliminates the separate hot rolling step as well as the soaking and preheating step and scalping of the ingot. Continuous casting machines such as belt casters are generally capable of casting a continuous sheet of aluminum alloy less than 5 cm (2 inches) thick and as wide as the design width of the caster (typically as much as 208 cm (82 inches)). The continuous cast alloy can be rolled to a thinner gauge immediately after casting in a continuous hot or warm rolling process.

Typically, as with DC cast material, continuously cast sheet receives one interanneal and one final anneal. For example, the alloy may be cast and hot or warm rolled to a thickness of about 0.127 to 0.254 cm (0.05 to 0.10 inches) on the continuous caster and then cold rolled to a thickness of about 0.005 to 0.05 cm (0.002 to 0.02 inches). At this stage, the sheet is interannealed to soften it and then it is cold rolled to the final gauge of 0.00076 to 0.00254 cm (0.0003 to 0.001 inches) and given a final anneal at a temperature of 325–450° C.

As may be seen from Table I, foils having significantly higher strength than standard household foils (conventionally produced with alloys such as 1100, 1200 and 8111) can be produced from certain currently available alloys, such as DC cast alloy 8006 and continuously cast alloy 8015. Unfortunately, both of these materials create certain problems. As mentioned above, the DC casting process used with alloy 8006 is relatively expensive. However, continuously cast 8015 is very difficult to roll and cast. Recoveries are poor, both during casting and rolling, because of problems such as edge cracking. The excessive work hardening rate results in lower rolling productivity due to increased number of passes required thereby increasing cost. This eliminates most if not all of the cost advantages of continuous casting.

The high iron content in both 8006 (1.2–2.0% Fe) and 8015 (0.8–1.4% Fe) is another problem. Alloys with this level of iron cannot be recycled with valuable low iron alloys—the predominant example being beverage can sheet—without blending in primary low iron metal to reduce the overall iron level in the recycled metal. As a result, alloys such as 8006 and 8015 are sometimes unacceptable for recycling. If they are accepted at all, it may only be with a cost penalty. Additionally, high iron contents make these alloys difficult to cast and to roll into foil.

Japanese patent publication number 62149838 filed on Feb. 2, 1986 by Showa Aluminum Corporation of Japan discloses an aluminum alloy foil having good formability. The foil is produced by subjecting the alloy containing specific amounts of Fe and Mn to homogenizing treatment, hot rolling, and then to cold rollings with interposing process annealing between the cold rolling steps. The interannealing is carried out at 400° C. for one hour.

DISCLOSURE OF THE INVENTION

According to one aspect of the present invention, there is provided a process of producing aluminum foil having dead fold foil characteristics with a yield strength of at least 89.6 MPa (13 ksi), and ultimate tensile strength or at least 103.4 Ma (15 ksi) and a Mullen rating of at least 89.6 kPa (13 psi) at a gauge of 0.0015 cm (0.0006 inch), wherein an aluminum alloy is cast to form an ingot or continuous sheet, the ingot or continuous sheet is cold rolled to produce a cold worked sheet, the cold worked sheet is interannealed, the interannealed sheet is cold rolled to a final gauge sheet of foil thickness, and the final gauge sheet is annealed. in the invention, the aluminum alloy is selected to contain an amount of manganese in the range of 0.05 to 0.15% by weight, and the cold worked sheet is interannealed at a temperature in the range of 200 to 260° C.

This invention provides a process of producing a high strength aluminum foil with mechanical properties comparable to foils made of 8006 or 8015 alloys, without the difficulties and cost penalties associated with the production and rolling of 8006 and 8015 alloys. The process may be used with a number of alloys that are relatively easy to cast and roll with good recoveries (typically rolling recoveries are about 80%). The invention is most preferably carried out with alloys having low iron contents (i.e. less than about 0.8% by weight, and preferably 0.1 to 0.7% by weight) since higher iron contents make casting and rolling more difficult, and make the resulting scrap more expensive to recycle. Thus, foils made with this process can be produced relatively easily and recycled without cost penalty.

The invention requires that the manganese content of the alloy be between about 0.05 and about 0.5%, preferably about 0.1% to about 0.12%, by weight. We have found that foils with properties matching those of 8006 or 3015 foils can be produced, with superior recoveries and other operating advantages, by controlling the manganese level within these ranges and controlling the interanneal and optionally the final annealing temperatures.

As with previous processes for producing foil, sheet produced in the processes of this invention is interannealed, typically after one to three cold rolling passes. The process of the present invention differs from conventional techniques, however, by maintaining the annealing temperatures at relatively low levels that control the amount of manganese that precipitates from the alloy. We have found that manganese precipitation can be controlled by controlling the interanneal temperature. This controlled precipitation produces an interannealed sheet that can be rolled to final gauge with good recoveries, and produces a finished foil with superior mechanical properties.

The interannealing temperature is maintained at a level that will cause substantially complete recrystallization of the cold worked sheet without causing unacceptable precipitation of manganese. The interannealing temperature in the process of the present invention is preferably about 200 to 260° C., and more preferably between about 230 and about 250° C. The annealed sheet will contain at least about 0.05%, preferably at least 0.08%, and even more preferably about 0.09% to about 0.12% manganese in solid solution, where it can have the greatest impact on the mechanical properties of the finished foil.

Final annealing temperatures are also preferably controlled, and are matched to the interannealing temperatures and manganese content of the alloy to achieve the best balance of mechanical properties and processing characteristics. As with the interannealing temperatures, the final annealing temperatures are significantly below the annealing temperatures utilized in conventional foil production processes. In the processes of the present invention, the final annealing temperature is preferably about 250° C. to about 325° C., and more preferably between about 260° C. and about 290° C. With the levels of manganese that remain in solid solution following interannealing, the final gauge sheet can be finally annealed at these temperatures to produce a soft, formable foil, wish the dead fold characteristic that is very much desired in an aluminum foil, while still retaining strength and other mechanical properties equivalent to 8015 foil.

BEST MODE FOR CARRYING OUT THE INVENTION

Figure 1:
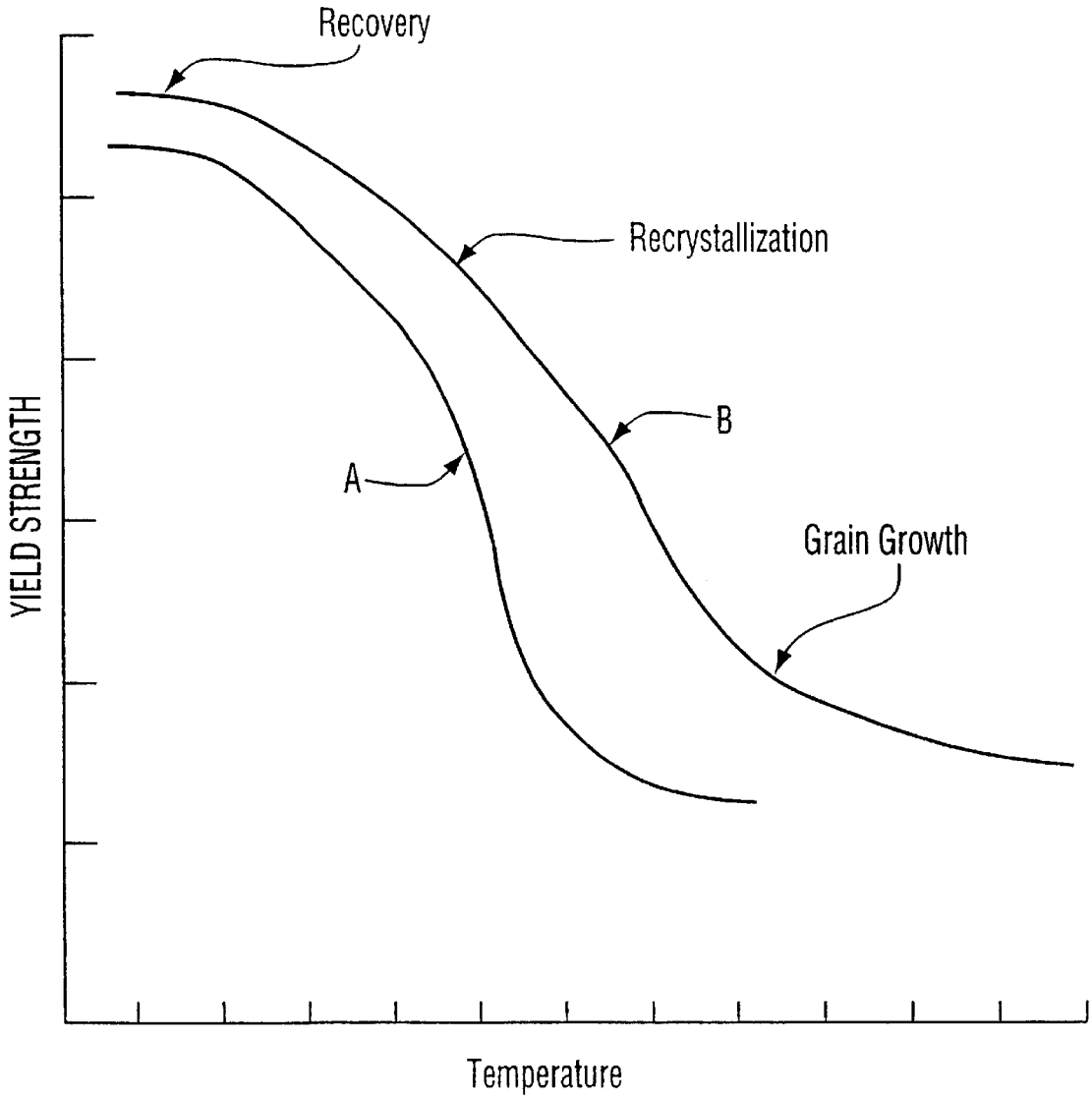
FIG. 1 has annealing curves illustrating the qualitative effects of different manganese contents on an aluminum alloy.

The process of this invention can be practiced with a wide variety of alloy compositions including modifications of alloy compositions currently utilized for the production of foil stock. As mentioned above, the alloy contains about 0.05 to about 0.15% manganese by weight in order to achieve the benefits of this invention. Strong foils can be produced with alloys containing higher levels of manganese, such as 8015, but these alloys tend to be very difficult to roll because of the higher work hardening rate. With levels of manganese below about 0.05%, mechanical properties decline precipitously as the final annealing temperature increases, which makes it very difficult to obtain strong foil. Thus, the manganese level lies between about 0.05% and about 0.15%, preferably between about 0.095% and about 0.125%.

Other alloying ingredients frequently used in foil alloys, such as silicon, iron, copper and magnesium, do not appear to affect the interrelationship between annealing temperatures, formability and final mechanical properties in the same manner as manganese. However, it will normally be desirable to include at least some of these ingredients in order to control certain other properties. Typically, the alloy may include from about 0.05% to about 0.6% silicon, about 0.1% to about 0.7% iron, and up to about 0.25% copper with the balance aluminum and incidental impurities. Silicon is known to influence the surface quality of the foil stock, thereby avoiding smut in the rolling process. Silicon, iron and copper all increase the strength of the finished product. Alloys useful in the process of this invention can be cast with any conventional casting processes, including DC ingot casting process as well as continuous casting systems. However, because of the processing economies available with continuous casting, this approach is preferable. Several continuous casting processes and machines in current commercial use are suitable, including belt casters, block casters and roll casters. These casters are generally capable of casting a continuous sheet of aluminum alloy less than one inch thick and as wide as the design width of the caster, which may be in the range of 178 to 216 cm (70 to 85 inches). The continuously cast alloy can be rolled, if desired, to a thinner gauge immediately after casting in a continuous hot and warm rolling process. This form of casting produces an endless sheet which is relatively wide and relatively thin. If hot and warm rolled immediately after casting the sheet leaving the casting and rolling process may have a thickness of about 0.127 to 0.254 cm (0.05 to 0.1 inches) when coiled.

The sheet is then cold rolled to final gauge in a series of passes through a cold rolling mill. As is customary in this type of rolling process, an interanneal is performed, usually after the first or second pass, so that the sheet can be rolled to final foil gauge, and the foil is given a final annealing treatment when it has been rolled to the desired gauge in order to produce a soft, dead fold foil with a desired level of formability. However, in the processes of this invention, unlike conventional processes, both the interannealing temperature and the final annealing temperature are controlled and coordinated with the manganese level in the alloy in order to produce superior mechanical properties in the final foil without sacrificing processing characteristics.

FIG. 1 qualitatively illustrates the relationship between annealing temperature and yield strength at different annealing temperatures for the aluminum alloys used in the foil production processes of this invention. Curve A represents an alloy having about 0.03% manganese in solid solution. Figure B represents an alloy with about 0.15 manganese in solid solution. On these curves, as the temperature of the alloy is initially increased over the flat initial section of the curve, frequently called the recovery region, rearrangement of dislocations caused in previous cold working begins. A recrystallization region follows, in which the original crystalline structure of the alloy prior to cold working is restored. As the alloy recrystallizes, mechanical properties fall while elongation increases. The bottom portion of the curve shows a recrystallized material whose properties remain relatively constant while some grain growth occurs.

Conventional annealing temperatures frequently cause precipitation of alloying ingredients such as manganese during recrystallization. With manganese levels between about 0.05% and about 0.15% the manganese is quickly precipitated out at interannealing temperatures exceeding 260° C. As can be appreciated from curve A in FIG. 1, this leaves a foil whose properties decline precipitously with increasing final anneal temperature, making it difficult if not impossible to obtain mechanical properties comparable to 8015 foil. The contrast with foils having about 0.15% maganese in solid solution, represented by curve B, is evident. With the increased manganese level, the mechanical properties of the foil decline slowly with increasing final annealing temperature. This makes it possible to choose an annealing temperature which produces both mechanical properties comparable with 8006 or 8015 alloy and dead fold characteristics.

We have found that foil having mechanical properties comparable to those of 8015 alloy can be produced without the excessive work hardening, edge cracking, poor recoveries and other problems normally associated with the production of 8015 alloy. We achieve this with alloy compositions containing between about 0.05% and about 0.15%, preferably about 0.095% to about 0.125% manganese, and interannealing at a temperature between about 200° C. and about 260° C., preferably between about 230° C. and about 250° C. This finding is surprising because manganese has a very low diffusion coefficient and its precipitation rate at temperatures below 300° C. would not be expected to be very high. Nonetheless, as the examples set forth below illustrate, alloys with a manganese level between about 0.05% and 0.15% can be interannealed successfully at the lower temperatures described herein, and the interannealed sheet can be further rolled and finally annealed to produce foil stock having superior properties.

Higher interanneal temperatures can be tolerated with increasing levels of manganese. For example, at a manganese level of 0.2%, the level of alloy 8015, an interanneal temperature of 275° C. produces the superior mechanical properties shown in Table 1. However, this high level of manganese results in lower productivity due to high work hardening, edge cracking and other problems which largely offset the superior properties obtained with this composition.

We prefer to interanneal at temperatures slightly below the point where manganese begins to precipitate from solution. With typical alloy compositions such as those described above and a manganese content of about 0.1%, this temperature will normally be about 240° C. to 250° C. The optimum interannealing and final annealing conditions for any particular alloy may be determined empirically by conducting tests at various annealing temperatures. The interanneal is typically performed in a conventional batch annealing furnace with the annealing temperature measured by a thermocouple located near the center of the coil. The annealing times is typically about 4 to 8 hours, 2 to 3 hours is believed to be adequate for some alloys. Longer annealing times at the desired temperature should not be detrimental to the properties of the sheet, but are not preferred because they are less economical. Alternatively, a continuous annealing process in which the sheet is annealed before it is coiled may also achieve the desired results with annealing times as short as 30 seconds.

After interannealing the sheet is cold rolled to final gauge as in conventional processes. Typically, the thickness of the sheet will be reduced by about 80 to about 99%, in 3 to 5 passes, to a final gauge of about 0.00076 to 0.00254 cm (0.0003 to 0.001 inches). The sheet is then finally annealed to achieve the desired properties in the finished foil.

The processes of this invention provide a controllable rate of decrease in the properties of the foil with the final annealing temperature. Thus, it is possible to select final annealing temperatures that provide desired properties in the finished foil. These temperatures, which may be between about 250° C. to about 325° C., and more preferably between about 260° C. and about 290° C., are typically somewhat lower than those used for high manganese alloys such as 8015 or 8006. As long as the temperature exceeds the boiling point of rolling lubricants used in the process, one can obtain satisfactory wettability of the foil annealed at these lower temperatures. If the removal rate for volatile materials in the residual oil is reduced with the lower annealing temperatures, the time of the final anneal can be increased to compensate.

The final annealing temperatures in the processes of this invention are selected to provide a soft, dead fold foil. The final annealing time is selected to insure complete removal of the rolling lubricants. The minimum final annealing time using a batch annealing process is therefore dependent on the size of the coil and the annealing temperature. Larger coils, having a longer path for the rolling oil vapor to travel, require longer annealing time. Lower annealing temperature similarly reduces the rate of removal of rolling lubricant. Typically, for a 30 cm (12 inch) wide coil, annealing at 290° C. for 18–24 hours is acceptable. The exact final annealing practice for each coil size may be determined by trial and error. As may be seen from the following examples, the final annealing temperature is coordinated with the interannealing temperature and the manganese level in the alloy to provide optimal conditions.

EXAMPLE 1

Aluminum alloy containing 0.1% menganese, 0.4% silicon and 0.6% iron was cast as a sheet on a twin belt caster and war rolled to a thickness of 0.145 cm (0.057 inches). The sheet was cold rolled to a thickness of 0.011 cm (0.0045 inches). One half of this material (coil A) was interannealed at 275° C. and the other half (coil B) was interannealed at 245° C. The two smaller coils were cold rolled to a thickness of 0.00145 cm (0.00057 inches). Samples were taken from each coil and annealed in a laboratory at different temperatures, producing the following results.

| Coil | Inter-anneal Temp. ° C. | Final Anneal Temp. ° C. | UTS MPa (ksi) | Yield Strength Mpa (ksi) | Mullen kPa (psi) |
|---|---|---|---|---|---|
| A | 275 | 245 | 107.63 (15.61) | 94.04 (13.64) | 37.92 (5.5) |
| | | 255 | 71.36 (10.35) | 71.36 (10.35) | 60.67 (8.8) |
| | | 270 | 66.05 (9.58) | 66.05 (9.58) | |
| | | 290 | 68.81 (9.98) | 68.81 (9.98) | |
| B | 245 | 250 | 149.62 (21.7) | 138.86 (20.14) | 127.55 (18.5) |
| | | 270 | 134.10 (19.45) | 124.24 (18.02) | 110.32 (16) |
| | | 290 | 113.62 (16.48) | 113.63 (16.48) | 68.95 (10) |

This example illustrates the effect of interanneal temperature on the mechanical properties of the foil after the final anneal at different temperatures. As can be seen, when the interanneal temperature is 275° C., mechanical properties such as yield strength or UTS fall precipitously with increasing final anneal temperature, making it extremely difficult to choose a final anneal temperature at which properties comparable to 9015 (Table 1) can be obtained. However, when the interanneal temperature is decreased to 245° C., the rate of decrease of mechanical strength with increasing final temperature slows down considerably, making it practical to anneal the foil at a temperature at which properties comparable to 8015 can be obtained.

EXAMPLE 2

Coil B from Example 1 was given a final anneal of a temperature of 330° C., and had the following properties;

| UTS Mpa (ksi) | Yield Strength MPa (ksi) | Mullen kPa (psi) | Elongation |
|---|---|---|---|
| 82.53 (11.97) | 57.85 (8.39) | 68.95 (10) | 1.5% |

The final properties of this material were not in the desired range because the final anneal temperature was too high.

EXAMPLE 3

A coil of aluminum sheet containing 0.1% manganese, 0.4% silicon and 0.6% iron was produced by the continuous casting process described in Example 1. The coil was cold rolled to a thickness of 0.011 cm (0.0045 inches), interannealed at a temperature of 230° C. and rolled to final thickness of 0.0015 cm (0.00059 inches). This coil was then given a final anneal in the plant at a temperature of 290° C. The properties of the foil were:

| UTS Mpa (ksi) | Yield Strength MPa (ksi) | Mullen kPa (psi) | Elongation |
|---|---|---|---|
| 111.70 (16.2) | 88.25 (12.8) | 75.84 (11) | 1.5% |

The properties of this foil are quite close to desired levels, although the Mullen value wag somewhat lower. Lower final annealing temperature should bring them to a level close to the properties of 8015 foil.

EXAMPLE 4

Another coil of aluminum sheet containing 0.3% manganese, 0.4% silicon and 0.6% iron was cast using the same belt casting process. The coil was cold rolled to a thickness of 0.011 cm (0.0045 inches) and annealed at 245° C. The annealed coil was further cold rolled to a thickness of 0.0015 cm (0.00060 inches) and finally annealed at 285° C. The properties were:

| UTS MPa (ksi) | Yield strength MPa (ksi) | Mullen kPa (psi) | Elongation |
|---|---|---|---|
| 142.72 (20.7) | 122.73 (17.8) | 170.30 (24.7) | 2.1% |

These examples demonstrate that by choosing the right combination of manganese content, interanneal temperature and final anneal temperature a high strength foil with properties even superior to 8015 can be obtained. The processes of this invention produce these superior foils without the excessive work hardening, edge cracking and other problems that typify the production of 8015 foil. As those skilled in the art will appreciate, many modifications may be made to the compositions and processes described herein. These examples and the balance of the foregoing description are merely illustrative. They are not meant to limit the scope of this invention, which is defined by the following claims.

What is claimed is:

1. A process of producing aluminum foil having dead fold foil characteristics with a yield strength of at least 89.6 MPa (13 ksi), and ultimate tensile strength of at least 103.4 MPa (15 ksi) and a Mullen rating of at least 89.6 kPa (13 psi) at a gauge of 0.0015 cm (0.0006 inch), which comprises casting an aluminum alloy to form an ingot, cold rolling the ingot to produce a cold worked sheet, interannealing the cold worked sheet, cold rolling the interannealed sheet to a final gauge sheet of foil thickness, and interannealing the final gauge sheet; wherein the aluminum alloy is selected to contain an amount of manganese in the range of 0.05 to 0.15% by weight, and the cold worked sheet is interannealed at a temperature in the range of 200 to 260° C.

2. The process of claim 1, wherein said cold worked sheet is interannealed at a temperature in the range of 230 to 250° C.

3. The process of claim 1, wherein said final gauge sheet is annealed at a temperature in the range of 250 to 325° C.

4. The process of claim 1, wherein said final gauge sheet is annealed at a temperature in the range of 260 to 290° C.

5. The process of claim 1, wherein said cast aluminum alloy has at least about 0.05% manganese in solid solution after interannealing.

6. The process of claim 1, wherein said cast aluminum alloy includes at least about 0.1% manganese and said interannealed sheet contains at least about 0.08% manganese in solid solution.

7. The process of claim 6, wherein said interannealed sheet contains at least about 0.095% manganese in solid solution.

8. The process of claim 1, wherein said cold worked sheet is interannealed at a temperature that produces an interannealed sheet that has at least about 0.05% manganese in solid solution, but is softened sufficiently to permit the sheet to be rolled to final gauge with a reduction in thickness of at least about 80% of the interannealed sheet.

9. A process of producing aluminum foil having dead fold foil characteristics with a yield strength of at least 89.6 MPa (13 ksi), and ultimate tensile strength of at least 103.4 MPa (15 ksi) and a Mullen rating of at least 89.6 kPa (13 psi) at a gauge of 0.0015 cm (0.0006 inch), which comprises casting an aluminum alloy to form an ingot, cold rolling the ingot to produce a cold worked sheet, interannealing the cold worked sheet at a temperature that produces an interannealed sheet that has at least about 0.05% manganese in solid solution, but is softened sufficiently to permit the sheet to be rolled to final gauge with a reduction in thickness of at least about 80%, cold rolling the interannealed sheet from a thickness of 0.05 to 0.005 cm (0.02 to 0.002 inches) to a final gauge of 0.0008 to 0.0025 cm (0.0003 to 0.001 inches), and annealing the final gauge sheet; wherein the aluminum alloy is selected to contain an amount of manganese in the range of 0.05 to 0.15% by weight, and the cold worked sheet is interannealed at a temperature in the range of 200 to 260° C.

10. A process in accordance with claim 9, wherein said interannealed sheet is cold rolled to a final gauge of about 0.0015 cm (0.0006 inches).

11. The process of claim 9, wherein said final gauge sheet is finally annealed at a temperature of about 250° C. to about 325° C.

12. The process of claim 1, wherein said aluminum alloy comprises at least 0.095% manganese by weight.

13. The process of claim 1, wherein said aluminum alloy contains from 0.095% to 0.125% manganese by weight, and said cold worked sheet is interannealed at a temperature between 230° C. and 250° C. to produce interannealed sheet containing at least 0.08% manganese in solid solution.

14. The process of any one of claims 1 to 13, wherein said aluminum alloy is selected to have an iron content of less than 0.8% by weight.

15. The process of any one of claims 1 to 13, wherein said aluminum alloy is selected to have an iron content in the range of 0.1 to 0.7% by weight.

16. A process of producing aluminum foil having dead foil characteristics with a yield strength of at least 89.6 MPa (13 ksi), and ultimate tensile strength of at least 103.4 MPa (15 ksi) and a Mullen rating of at least 89.6 kPa (13 psi) at a aguge of 0.0015 cm (0.0006 inch), wherein an aluminum alloy is continuously cast to form a continuous sheet, the continuous sheet is cold rolled to produce a cold worked sheet, the cold worked sheet is interannealed at a temperature in the range of 200 to 260° C., the interannealed sheet is cold rolled to final gauge sheet of foil thickness, and the final gauge sheet is annealed, wherein said aluminum alloy comprises 0.05 to 0.15% by weight manganese, 0.05 to 0.6% by weight silicon, 0.1 to 0.7% by weight iron, and up to 0.25% by weight copper, with the balance aluminum and incidental impurities.

* * * * *